United States Patent [19]

Taguchi

[11] Patent Number: 4,747,753

[45] Date of Patent: May 31, 1988

[54] SLANT PLATE TYPE COMPRESSOR WITH VARIABLE DISPLACEMENT MECHANISM

[75] Inventor: Yukihiko Taguchi, Maebashi, Japan

[73] Assignee: Sanden Corporation, Gunman, Japan

[21] Appl. No.: 83,255

[22] Filed: Aug. 10, 1987

[30] Foreign Application Priority Data

Aug. 8, 1986 [JP] Japan ..... 61-185322

[51] Int. Cl.[4] ..... F04B 1/26

[52] U.S. Cl. ..... 417/222; 417/270

[58] Field of Search ..... 417/222, 270, 282

[56] References Cited

U.S. PATENT DOCUMENTS

| | | | |
|---|---|---|---|
| 3,861,829 | 1/1975 | Roberts et al. | 417/270 X |
| 3,972,652 | 8/1976 | Minnicino | 417/277 |
| 4,037,993 | 7/1977 | Roberts | 417/222 |
| 4,073,603 | 2/1978 | Abendschein et al. | 417/222 |
| 4,145,163 | 3/1979 | Fogelberg et al. | 417/222 |
| 4,174,191 | 11/1979 | Roberts | 417/222 |
| 4,231,713 | 11/1980 | Widdowson et al. | 417/222 |
| 4,428,718 | 1/1984 | Skinner | 417/222 |
| 4,433,596 | 2/1984 | Scalzo | 417/222 X |
| 4,475,871 | 10/1984 | Roberts | 417/222 |
| 4,502,844 | 3/1985 | Kimura et al. | 417/275 |
| 4,526,516 | 7/1985 | Swain et al. | 417/222 |
| 4,533,299 | 8/1985 | Swain et al. | 417/222 |
| 4,586,874 | 5/1986 | Hiraga et al. | 417/222 |
| 4,606,705 | 8/1986 | Parekh | 417/222 |
| 4,632,640 | 12/1986 | Terauchi | 417/222 X |
| 4,664,604 | 5/1987 | Terauchi | 417/222 |
| 4,669,272 | 6/1987 | Kawai et al. | 417/270 X |
| 4,685,866 | 8/1987 | Takenaka et al. | 417/222 |
| 4,687,419 | 8/1987 | Suzuki et al. | 417/222 |
| 4,688,997 | 8/1987 | Suzuki et al. | 417/222 |
| 4,702,677 | 10/1987 | Takenaka et al. | 417/222 |
| 4,712,982 | 12/1987 | Inagaki et al. | 417/222 |

FOREIGN PATENT DOCUMENTS

| | | | |
|---|---|---|---|
| 139982 | 1/1951 | Australia . | |
| 0190013 | 7/1964 | European Pat. Off. . | |
| 0219283 | 12/1969 | European Pat. Off. . | |
| 1906226 | 4/1969 | Fed. Rep. of Germany . | |
| 55380 | 3/1986 | Japan | 417/222 |
| 145379 | 7/1986 | Japan | 417/222 |
| 2153922 | 8/1985 | United Kingdom | 417/222 |

*Primary Examiner*—Carlton R. Croyle
*Assistant Examiner*—Paul F. Neils
*Attorney, Agent, or Firm*—Banner, Birch, McKie & Beckett

[57] ABSTRACT

An improved variable displacement mechanism for a slant plate type compressor, such as a wobble plate type compressor, which increases the cooling efficiency of the compressor is disclosed. The variable displacement mechanism includes a passageway to allow communication between the suction chamber and the crank chamber, and a valve control mechanism for controlling the opening and closing of the passageway. The valve control mechanism includes a first valve control device with a first valve element which opens and closes a hole linking the suction chamber and the crank chamber. The first valve control device acts in accordance with the pressure within its interior space. The valve control mechanism also includes a second valve control device which controls the interior pressure of the first valve control device. The second valve control device is responsive to the actual operating conditions of the compressor. In one embodiment, the second valve control device includes a coil spring made of a shaped memory alloy which expands and contracts in accordance with the temperature within the second valve control device.

12 Claims, 8 Drawing Sheets

FIG. 14
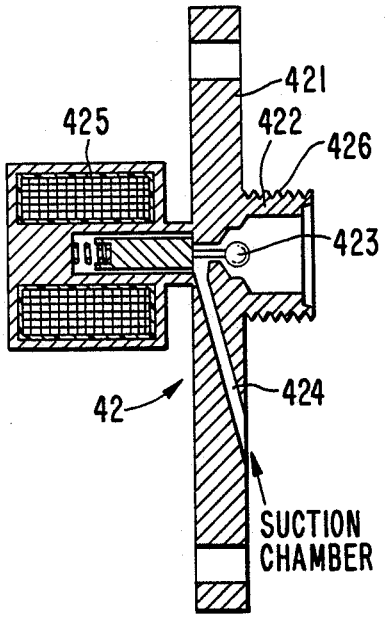
FIG. 16
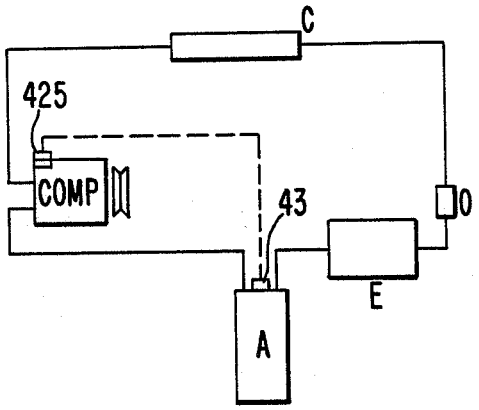
FIG. 15
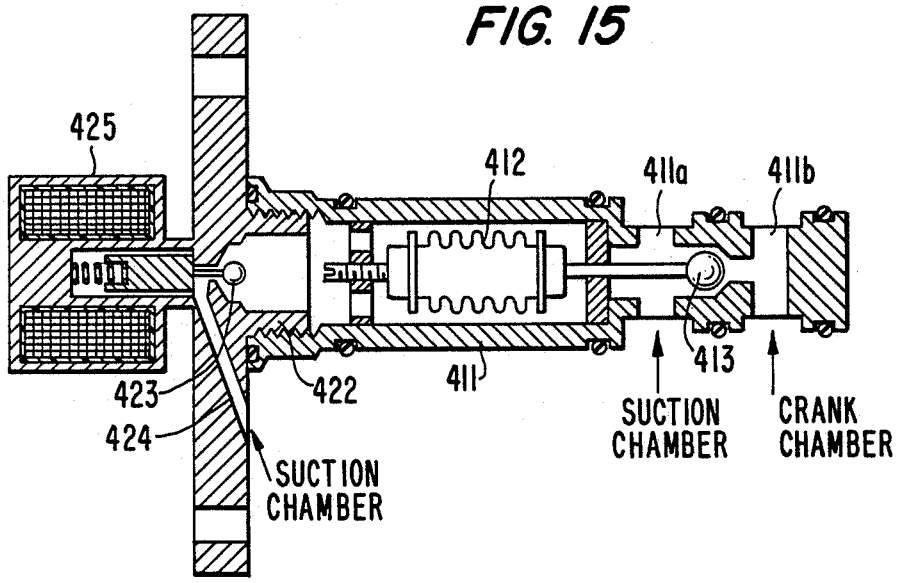
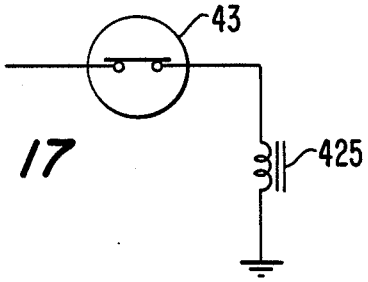
FIG. 17

SLANT PLATE TYPE COMPRESSOR WITH VARIABLE DISPLACEMENT MECHANISM

CROSS-REFERENCE TO RELATED APPLICATIONS

This application is related to Ser. No. 075,968 filed on July 21, 1987, still pending.

BACKGROUND OF THE INVENTION

1. Field of Invention

This invention relates to a refrigerant type compressor especially for use in automotive air-conditioning systems. More particularly, the present invention relates to a variable displacement mechanism for a slant plate type compressor such as a wobble plate type compressor.

2. Description of the Prior Art

Slant plate type compressors, such as wobble plate type compressors, with variable displacement mechanisms which are suitable for use in an automobile air conditoner are well known in the art. One example is shown in U.S. Pat. No. 3,861,829 issued to Roberts et al. In prior art compressors, the inclination angle of the wobble plate is changed by controlling the pressure in the crank chamber by adjusting the gas pressure on the rear surface of each of the pistons.

Roberts et al. '829 discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber, can be used in any type of compressor which uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used to refer to any type of compressor, including wobble and swash plate types, which use a slanted plate or surface in the drive mechanism.

FIG. 1 shows the construction of a conventional wobble plate type compressor. Compressor 1 includes compressor housing 11 having cylinder block 12 at one end. Front end plate 14 is integrally formed with compressor housing 11 to cover the opening at its other end and to form crank chamber 13 within compressor housing 11. Cylinder head 15 is disposed on the opposite end of cylinder block 12 with valve plate 16 disposed therebetween. Drive shaft 2 is rotatably supported by radial bearing 3 in front end plate 14. Central bore 121 is formed in a central portion of cylinder block 12 and the inner terminal end of drive shaft 2 extends within central bore 121. Drive shaft 2 is rotatably supported by radial bearing 4 within central bore 121.

Rotor 5 is fixed on drive shaft 2 within crank chamber 13. Inclined plate 6 is hinged on rotor 5 through hinge mechanism 7 and inclined plate 6 rotates together with rotor 5 and drive shaft 2. The inclination or slant angle of plate 6 is varied by hinge mechanism 7 while it rotates. The slanted surface of inclined plate 6 is in close proximity to the surface of wobble plate 8. Thrust bearing 9 is disposed between the slanted surface of inclined plate 6 and the surface of wobble plate 8 to insure the smooth rotation of inclined plate 6. Guide bar 10 extends within crank chamber 13 from a hole bored in front end plate 14 into a hole bored in cylinder block 12. Lower portion of wobble plate 8 engages with guide bar 10, and wobble plate 8 reciprocates along guide bar 10. Guide bar 10 prevents the rotation of wobble plate 8.

A plurality of pistons 20 are slidably fitted within respective cylinders 17 which are formed through cylinder block 12. Pistons 20 are connected with wobble plate 8 by connecting rods 21. Cylinder head 15 is divided into two interior spaces, suction chamber 151 and discharge chamber 152.

The variable displacement mechanism includes communication passageway 22 which links crank chamber 13 with suction chamber 151, and valve mechanism 23 which is disposed in suction chamber 151 and controls the opening and closing of passageway 22.

As shown in FIG. 2, valve mechanism 23 includes first casing 231 and second casing 232 which is disposed on one open end of first casing 231 and serves to cover the opening. Second casing 232 is provided with communication holes **232*a* and 232*b* which provide communication between passageway 22 and suction chamber 151. Bellows 233 is located within the interior space of first casing 231 and is held in position by coiled spring 234. Valve element 235 is fixed to one end surface of bellows 233 and is slidably supported within a hole in supporting plate 236. Valve element 235 controls the opening and closing of cummunication hole 232*b* of second casing 232**.

Supporting plate 236 has a plurality of holes **236*a* which provide communication between hole 232*b* and the interior of casing 231. The outer peripheral surface of first casing 231 has at least one aperture 231a which links the interior space of first casing 231 with suction chamber 151. Crank chamber 13 is linked with suction chamber 151 through passageway 22, holes 232*a* and 232*b* of second casing 232 of valve mechanism 23, and aperture 231*a* of first casing 231 of valve mechanism 23 whenever valve element 235 slides to the left position opening communication hole 232*b***, as shown in FIG. 2.

In the prior art compressor, if the pressure within suction chamber 151 exceeds a predetermined value, bellows 233 within casing 231 contracts, causing valve element 235 to move toward the left. As a result, communication hole **232*b* is opened allowing crank chamber 13 to be linked with suction chamber 151 through aperture 231*a* and communication hole 232*a*. As a result of this link, the pressure in crank chamber 13 is equalized with the pressure in suction chamber 151 which causes the pressure on the rear surface of pistons 20 to be decreased. The decreased pressure on the rear surface of pistons 20 causes the inclination angle of wobble plate 8** to increase allowing the compressor to operate at its maximum capacity.

If the pressure in suction chamber 151 falls below the predetermined value, bellows 233 within first casing 231 expands and extends toward the right in FIG. 2. As a result, valve element 235 closes communication hole **232*b* and the communication link between crank chamber 13 and suction chamber 151 is terminated. The pressure in crank chamber 13 gradually increases, and the pressure on the rear surface of pistons 20 is increased, and as a result the inclination angle of wobble plate 8** is decreased. The reduced inclination angle of wobble plate 8 causes the compressor to operate at a reduced capacity.

When the prior art compressor is used in an automobile air-conditioning apparatus, if there is a high thermal load in the passenger compartment when compressor operation begins and the engine is driven at a high revolution rate, the pressure in suction chamber 151 rapidly decreases below the predetermined value even if the passenger compartment has been insufficiently cooled. Specifically, the variable displacement mechanism will operate to terminate the link between suction chamber 151 and crank chamber 13 even if the temperature in the passenger compartment is greater than desired.

As shown in FIG. 3, the cooling characteristics of the prior art compressor with a variable displacement mechanism are inferior to those of the conventional compressor without a variable displacement mechanism. Both the temperature in the passenger compartment and in the air outlet louver is significantly lower for the conventional compressor without the variable displacement mechanism. In addition, the pressure in crank chamber 13 is drastically changed in order to change the inclination angle of wobble plate 8. It is possible that the lubricating oil contained within crank chamber 13 will flow into suction chamber 151, and undesirable result.

SUMMARY OF THE INVENTION

It is a primary object of this invention to provide a slant plate type compressor with a variable displacement mechanism which more effectively controls the temperature in the passenger compartment of an automobile.

It is another object of this invention to provide a slant plate type compressor with a variable displacement mechanism which will improve the cooling characteristics of a cooling system.

A slant plate type compressor in accordance with one embodiment of this invention includes a compressor housing having a cylinder block which is provided with a plurality of cylinders. A crank chamber is formed within the compressor housing adjacent the cylinder block. A rear end plate includes a suction chamber and a discharge chamber and is disposed on the end surface of the cylinder block opposite the crank chamber. A plurality of pistons are slidably fitted within the cylinders and are reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to the drive shaft. The incline angle of the member is adjustable to vary the stroke length of the reciprocating pistons and thus vary the capacity or displacement of the compressor.

A variable displacement mechanism is disposed within the compressor housing and includes a passageway which communicates between the crank chamber and the suction chamber. A valve mechanism is disposed in the passageway and controls the communication of the crank chamber with the suction chamber to adjust the pressure in the crank chamber. The valve mechanism includes a first valve control device which has an isolated pressure sensitive chamber and a pressure sensitive element which operates a valve element to open and close the passageway between the crank chamber and the suction chamber. The valve mechanism also includes a second valve control device which controls the communication link between the suction chamber and the isolated pressure sensitive chamber of the first valve control device.

Further objects, features and other aspects of this invention will be understood from the following detailed description of the preferred embodiments of this invention with reference to the drawing figures.

BRIEF DESCRIPTION OF THE DRAWINGS

FIG. 14 is a cross sectional view of a second valve control device utilized in the compressor of FIG. 12.

FIG. 15 is a cross sectional view of a valve mechanism including the first valve control device of FIG. 13 and the second valve control device of FIG. 14 which is utilized in the wobble plate type compressor of FIG. 12.

FIG. 16 is a diagramatic view of a cooling circuit utilized in conjunction with the compressor of FIG. 12.

FIG. 17 is a diagramatic view illustrating the connection between a pressure switch and an electromagnetic device utilized in the cooling circuit of FIG. 16.

DETAILED DESCRIPTION OF THE PREFERRED EMBODIMENTS

Figure 1:
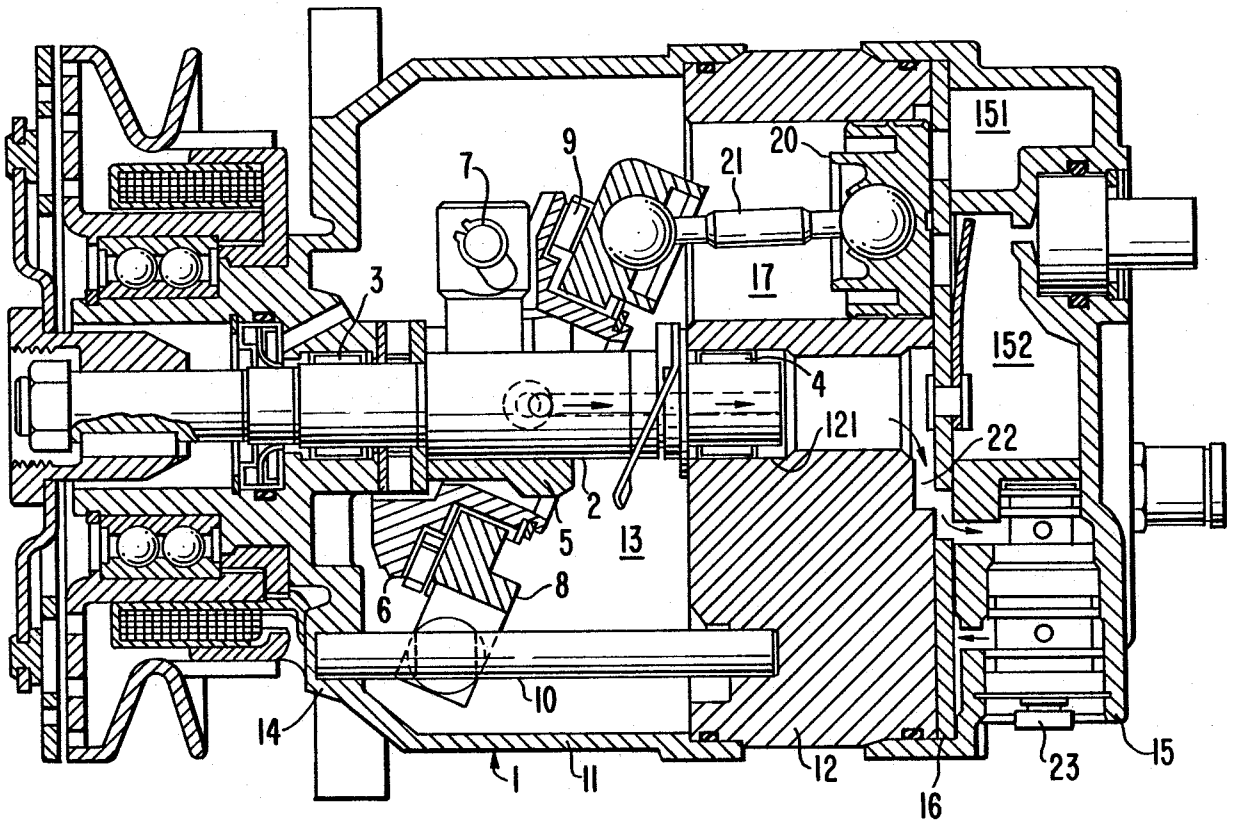
FIG. 1 PRIOR ART
FIG. 1 is a cross sectional view of a prior art wobble plate type compressor which is provided with a conventional variable displacement mechanism.
Figure 2:
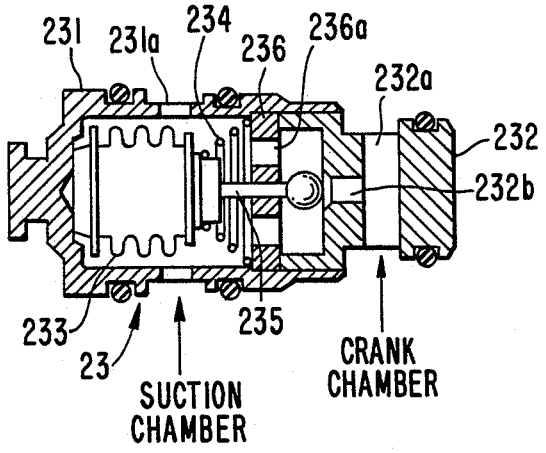
FIG. 2 PRIOR ART
FIG. 2 is a cross sectional view of a valve mechanism of a variable displacement mechanism of the compressor shown in FIG. 1.
Figure 3:
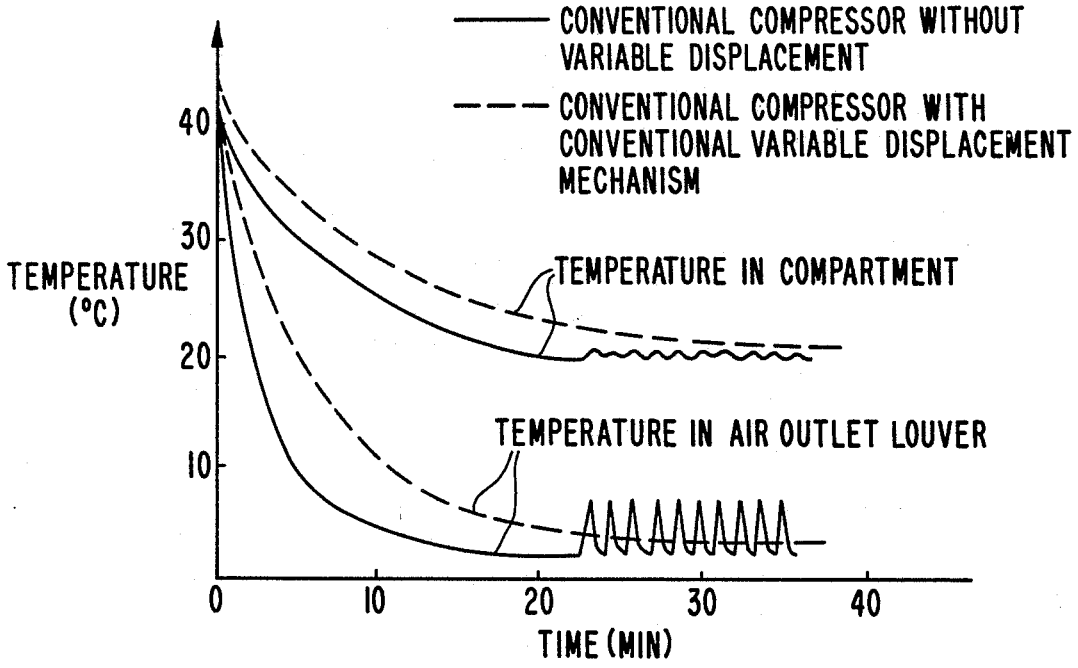
FIG. 3 is a graph illustrating the cooling characteristics for two types of prior art compressors.
Figure 4:
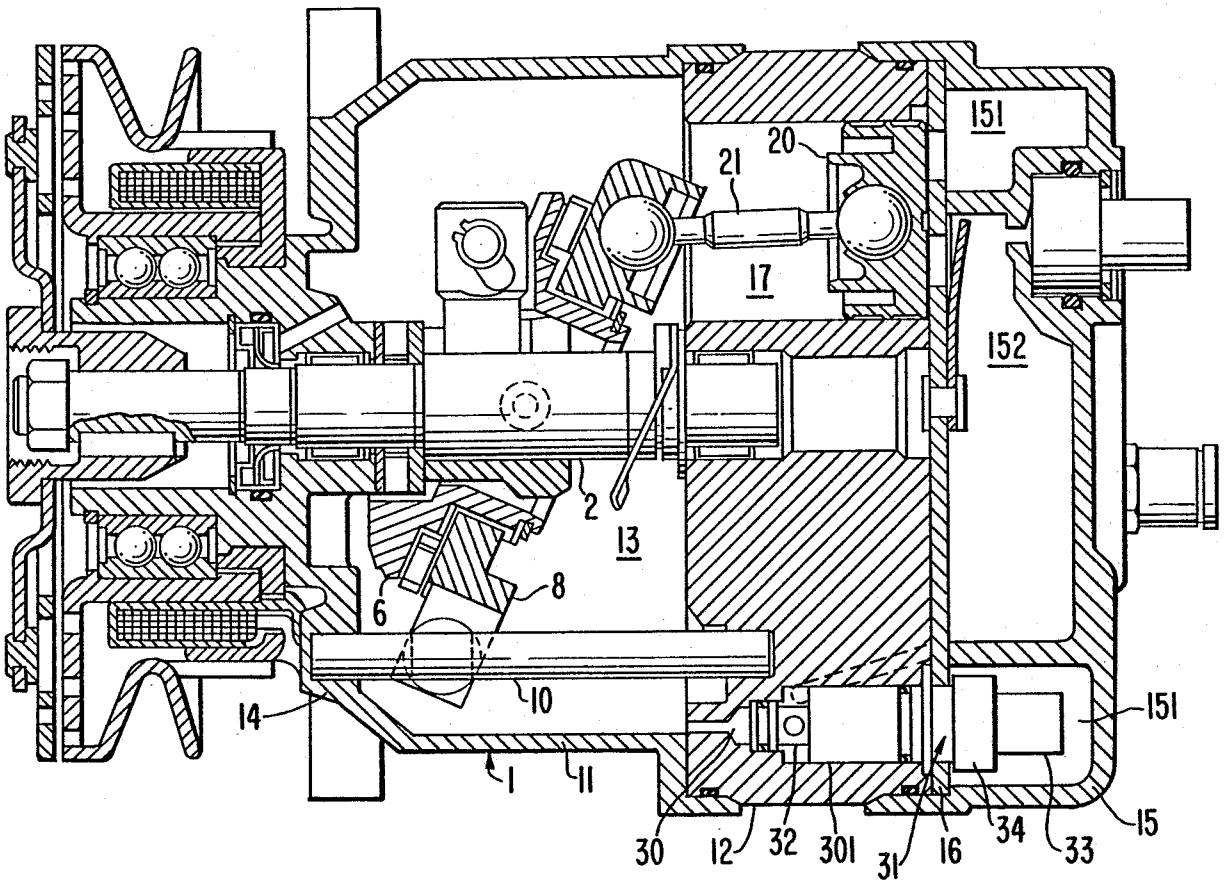
FIG. 4 is a cross sectional view of a wobble plate type compressor in accordance with one embodiment of this invention.

With reference to FIG. 4, a wobble plate type compressor with a variable displacement mechanism in accordance with one embodiment of this invention is shown. The basic construction of the wobble plate type compressor, except for the variable displacement mechanism, is similar to the compressor of FIG. 1. The same reference numerals will be used for elements in FIG. 4 which are identical to elements in FIG. 1.

The variable displacement mechanism includes passageway 30 formed through cylinder block 12 and valve plate 16 to link crank chamber 13 with suction chamber 151. Valve mechanism 31 is disposed within passageway 30 and suction chamber 151 to control communication between crank chamber 13 and suction chamber 151 through passageway 30. Valve mechanism 31 includes first valve control device 32 which is substantially disposed within large bore portion 301 of passageway 30 and which extends to suction chamber 151 at one end. Valve mechanism 31 also includes second valve control device 33 which is attached to one end of first valve control device 32 by lock nut 34. Second valve control device 33 is disposed within suction chamber 151.

Figure 5:
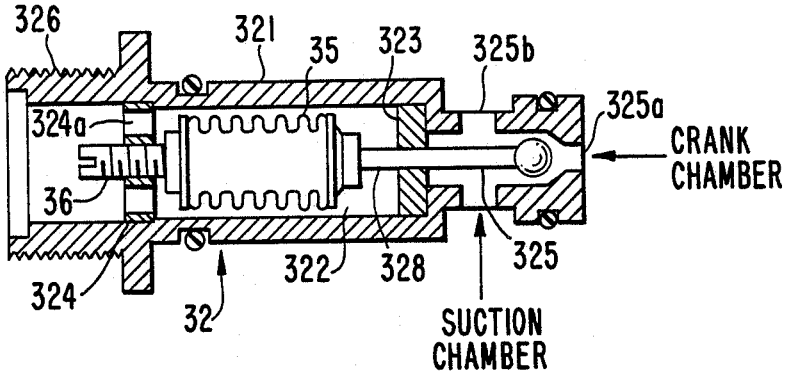
FIG. 5 is a cross sectional view of a first valve control device of a variable displacement mechanism of the compressor of FIG. 4.

Referring to FIG. 5, first valve control device 32 includes casing 321 in which isolated pressure sensitive chamber 322 is defined by two plates 323 and 324. Isolated pressure sensitive chamber 322 communicates with the interior space of second valve control device 33 through connecting holes **324*a* in plate 324. One end of casing 321 of first valve control device 32 is provided with communication chamber 325 and the other end of casing 321 of first valve control device 32 is provided with threaded portion 326 which is attached to second valve control device 33. Bellows 35 is disposed within isolated pressure sensitive chamber 322 and has valve element 328 fixed on one end surface. The interior of bellows 35 is maintained as a vacuum and contains a coiled spring (not shown). Adjusting screw 36 is located on the other end of bellows 35 and is supported within a threaded hole bored through a central portion of plate 324 to allow the operation of bellows 35**.

Valve element 328 is connected to bellows 35 at the end opposite adjusting screw 36. Valve element 328 extends into communication chamber 325 and is slidable supported through a central portion of plate 323. Hole **325*a* is located at one end of first valve control device 32 and is in communication with crank chamber 13. A plurality of holes 325*b* are located on the peripheral surface surrounding communication chamber 325 and communicate with suction chamber 151. Crank chamber 13 and suction chamber 151 communicate through holes 325*a* and 325*b*. The opening and closing of communication holes 325*a* and thus communication between crank chamber 13 and suction chamber 151 is controlled by valve element 328. Holes 325*b* communicate with suction chamber 151** as shown by the dashed lines in FIG. 4.

Figure 6:
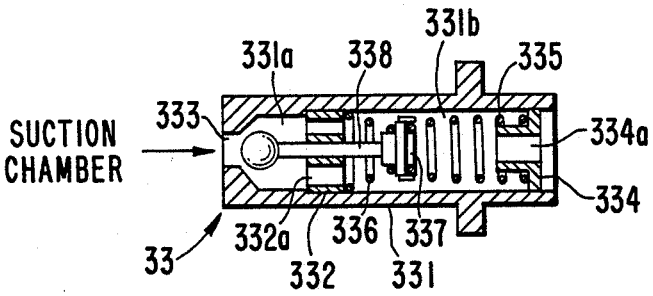
FIG. 6 is a cross sectional view of a second valve control device of a variable displacement mechanism of the compressor of FIG. 4.

Referring to FIG. 6, second valve control device 33 includes cup-shaped casing 331 and plate 332 which divides the interior space of second valve control device 33 into chambers **331*a* and 331*b*. Hole 333 is formed through one end of casing 331 to allow suction chamber 151 to communicate with chamber 331*a* of second valve control device 33. Spring supporting plate 334 is disposed within casing 331 at its other end and is provided with central hole 334*a* which allows chamber 331*b* in casing 331 to communicate with isolated pressure sensitive chamber 332 of first valve control device 32. Two coil springs 335 and 336 are disposed within chamber 331*b* and position spring retainer plate 337 on which valve element 338 of second valve control device 33 is fixed. Valve element 338 is slidably supported within a central hole of plate 332 and extends into chamber 331*a*. Valve element 338 controls the opening and closing of hole 333 and thus the communication link between suction chamber 151 and chamber 331*b***.

Coil spring 335 is disposed between retainer plate 337 and spring supporting plate 334 to control the sliding motion of valve element 338. Coil spring 335 is formed of a shaped memory alloy which may include titanium nickel or aluminum. Coil spring 336 is disposed between plate 332 and retainer plate 337 and maintains the position of retainer plate 337.

Figure 7:
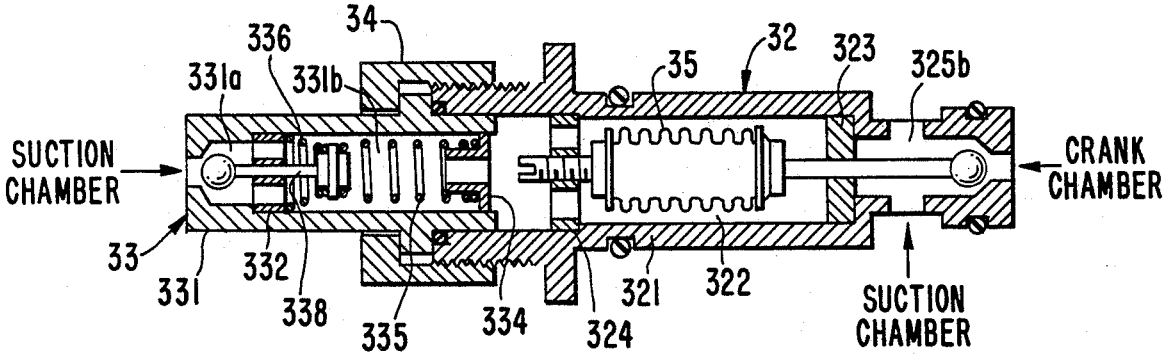
FIG. 7 is a cross sectional view of a valve mechanism including the first valve control device of FIG. 5 and the second valve control device of FIG. 6 and which is shown in the variable displacement mechanism in the compressor of FIG. 4.

Second valve control device 33 is fastened to first valve control device 32 by lock nut 34 which is screwed on threaded portion 326 of casing 32 as shown in FIG. 7. Isolated pressure sensitive chamber 322 communicates with suction chamber 151 through the interior space of second valve control device 33 and hole 333 in the end of second valve control device 33.

The shaped memory alloy of coil spring 335 assumes a predetermined expanded or contracted state at a predetermined high and low temperature, respectively. When the alloy is deformed under one temperature condition the memory allows it to return to its other predetermined state if the other temperature condition is reached. Thus, the shape of the coil is "remembered." For example, when spring 335 is subjected to a temperature higher than predetermined first temperature $t_1$, it expands. When spring 335 is subjected to a temperature lower than predetermined second temperature $t_2$, spring 335 contracts.

Figure 8:
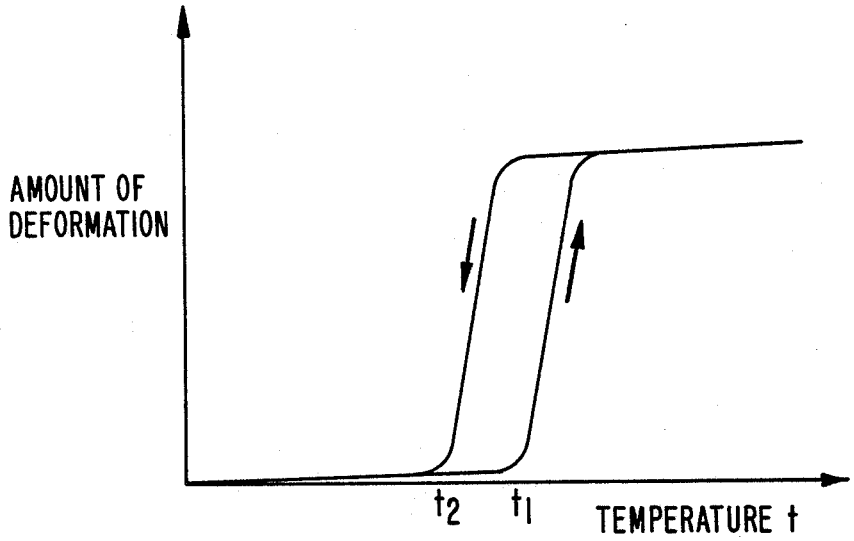
FIG. 8 is a graph illustrating the deformation characteristics of a coiled spring utilized in the second valve control device of FIG. 6.

As shown in the hysteresis loop of FIG. 8, coil spring 335 retains a deformed shape caused by one temperature extreme until the other temperature extreme is reached. Coil spring 335 expands when temperature $t_1$ is reached and retains this expanded shape when the temperature falls below $t_1$, unless the temperature falls to predetermined temperature $t_2$. Then coil spring 335 contracts and retains this contracted condition until temperature $t_1$ is again reached.

The operation of valve mechanism 31 is as follows. Since bellows 335 which is disposed in isolated pressure sensitive chamber 322 of first valve control device 32 contracts under the initial high pressure of suction chamber 151, valve element 328 of first valve control device 32 moves to the left as shown in FIG. 7. Communication hole **325*a* opens to allow communication between suction chamber 151 and crank chamber 13. If the heat load in the passenger compartment of an automobile is high, the temperature in the space in which coil spring 335 is disposed will exceed predetermined temperature $t_1$ and coil spring 335 expands. Second valve control device 33 communicates with the passenger compartment since second valve control device 33 is disposed within suction chamber 151. Thus, second valve control device 33 will be responsive to temperature changes in the passenger compartment air. The enclosed space of casing 331 and coil spring 335** are also ultimately responsive to the temperature change of passenger compartment air.

Expansion of coil spring 335 causes valve element 338 to move to the left in FIG. 7 to close hole 333 of casing 331 of second valve control device 33. This blocks communication between suction chamber 151 and the interior space of valve mechanism 31.

When compressor 1 is driven under these conditions, it operates under maximum capacity and the pressure in crank chamber 13 is reduced in accordance with the reduction of pressure in suction chamber 151 with which it communicates. Also, since isolated pressure sensitive chamber 322 and the interior space of second valve control device 33 are not in communication with suction chamber 151, valve mechanism 31 will not respond directly to a reduction of pressure in suction chamber 151. Even though the pressure in suction chamber 151 might be reduced sufficiently to allow the operation of first valve control device 32, this operation will not occur since suction chamber 151 is sealed off from the interior of valve mechanism 31 by valve element 388. Bellows 35 will not expand to slide valve element 328 to the right and isolate crank chamber 13 from suction chamber 151.

However, as the pressure in suction chamber 151 is reduced, the temperature in suction chamber 151 is also reduced. Thus, the temperature and therefore the pressure in the interior space of valve mechanism 31 will be reduced as well. Because there is a long delay before the temperature in the interior space of valve mechanism 31 is reduced, there is a delay before the reduction of pressure in the interior space of valve control device 31 after the reduction of pressure in suction chamber 151.

Even though the pressure in suction chamber 151 is below the predetermined pressure which would ordinarily operate first valve control device 32, if the temperature in the interior space of valve mechanism 31 exceeds the predetermined temperature which causes coil spring 335 to contract, communication between suction chamber 151 and the interior space of valve mechanism 31 is prevented and bellows 35 will not expand to cause valve element 328 to seal hole 325*a*. Under these conditions, the compressor will be driven at maximum piston stroke since suction chamber 151 and crank chamber 13 are in communication.

Once sufficient time has passed to allow the temperature in the interior space of valve mechanism 31 to fall below predetermined temperature $t_2$, coil spring 335 contracts and valve element 338 moves toward the right. Hole 333 is opened and suction chamber 151 is in communication with the interior space of valve mechanism 31 and isolated pressure sensitive chamber 322 of first valve control device 32. Since hole 333 is open, bellows 35 disposed within isolated pressure sensitive chamber 322 extends due to the decreased pressure in chamber 322. The extension of bellows 35 slides valve element 328 of first valve control device 32 to the right, closing hole 325*a*, and thereby terminating communication between crank chamber 13 and suction chamber 151.

The pressure within crank chamber 13 increases due to blow-by gas. This increases the pressure on the rear surface of pistons 20 and decreases the inclination angle of wobble plate 8 which reduces the capacity of compressor 1. However, the delay between the reduction of pressure in suction chamber 151 and the closing of hole 325*a* allows sufficient time for the passenger compartment to cool before compressor 1 operates at less than its maximum capacity.

Bellows 35 retains its extended state causing valve element 328 to close hole 325*a*. The communication link between crank chamber 13 and suction chamber 151 is closed until the temperature in the interior space of valve mechanism 31 again exceeds predetermined temperature $t_1$ which expands coil 335. Since the operation of first valve control device 32 is dependent on the charge of temperature in suction chamber 151, the capacity of compressor 1 is continuously controlled.

Figure 11:
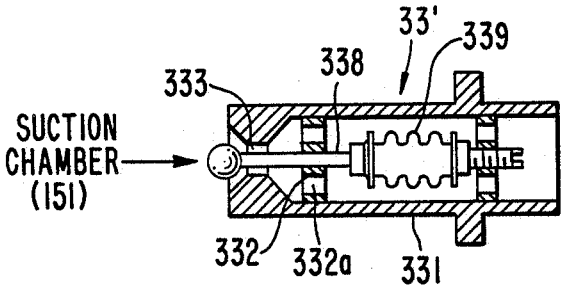
FIG. 11 is a cross sectional view of a second type of the second valve control device used in the valve mechanism of FIG. 7.

In the embodiment described above, second valve control device 32 includes coil spring 335 which operates valve element 338 in accordance with the temperature change in the interior space of valve mechanism 31. Alternatively, as shown in FIG. 11, second valve control device 33' may include bellows 339 to control the sliding motion of valve element 338 and thus the opening and closing of hole 333 in second valve control device 33'. The sliding motion of valve element 338 will depend directly on the change of pressure in suction chamber 151 which is still dependent on the change of temperature in the interior space of casing 331.

As described above, the variable displacement mechanism for a wobble plate type compressor includes two valve control devices. One valve control device directly controls the displacement change of compressor 1 by a suction pressure change by opening or closing the link between suction chamber 151 and crank chamber 13. The other valve control device controls the operation of the first valve control device in accordance with the passenger compartment environmental conditions. The second valve control device causes a delay in the operation of the first valve control device. Thus, the change in compressor capacity due to a change in suction pressure is delayed after the change in suction pressure. For example, in the initial stage of operation, although the compressor is driven at a high speed, when the suction pressure is reduced to the predetermined pressure which would ordinarily cause a reduction in compressor capacity, the first valve control device does not operate due to the control exerted on it by the second valve control device. The compressor capacity is not immediately reduced.

Figure 9:
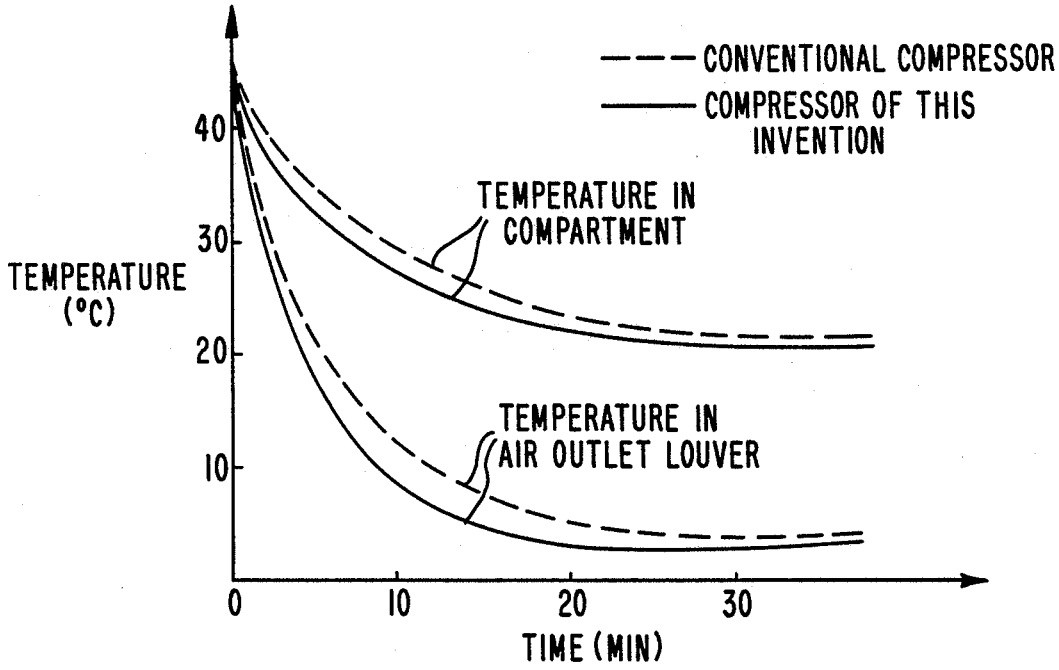
FIG. 9 is a graph illustrating the cooling characteristics for a conventional compressor and a compressor according to the present invention.
Figure 10:
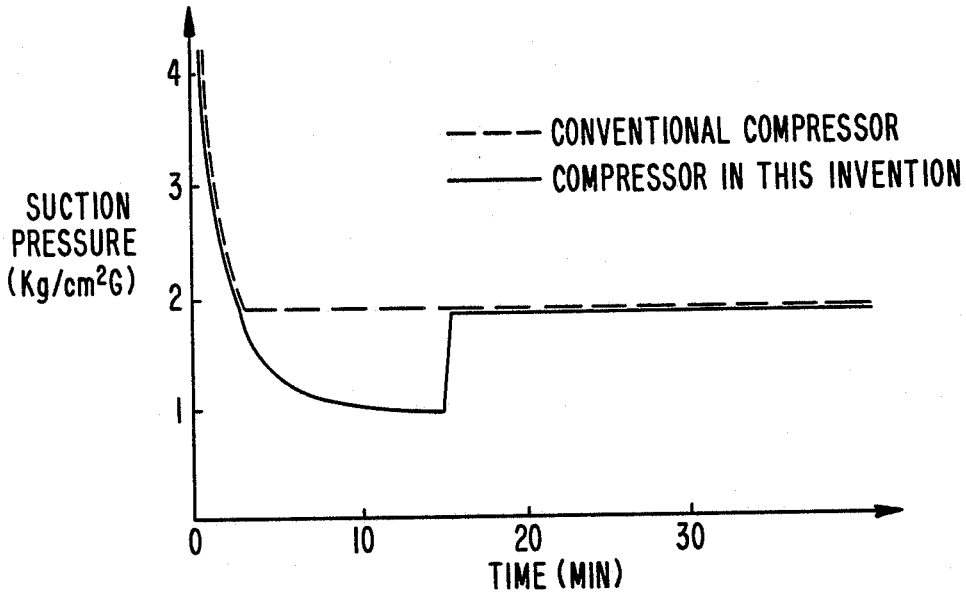
FIG. 10 is a graph illustrating the change in suction pressure as a function of time of a prior art compressor and a compressor according to this invention.

As shown in FIG. 10, in a conventional variable capacity compressor, the suction pressure is gradually reduced, and then is constantly maintained when the suction pressure reaches a predetermined level. In the present invention, the suction pressure is reduced below this predetermined level after the initial operation of the compressor, and then returns back to the predetermined level. Thus, the compressor operates at maximum capacity even while the suction pressure is well below the predetermined level because second valve control device 33 prevents first valve control device 32 from operating to isolate crank chamber 13 from suction chamber 151. As shown in FIG. 9, the cooling characteristics of the present invention are improved over prior art compressors and the temperature in the passenger compartment is more rapidly reduced.

FIGS. 12 to 15 show another embodiment of the invention. In this embodiment, environmental conditions external to compressor 1 causes second valve control device 42 to control first valve control device 41 which controls the compressor capacity.

Figure 13:
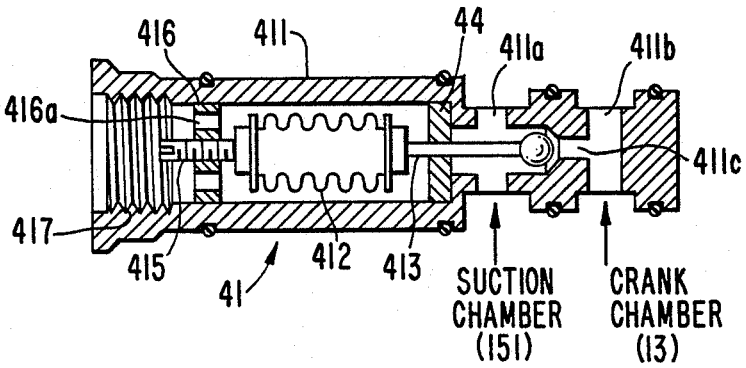
FIG. 13 is a cross sectional view of a first valve control device utilized in the compressor of FIG. 12.
Figure 12:
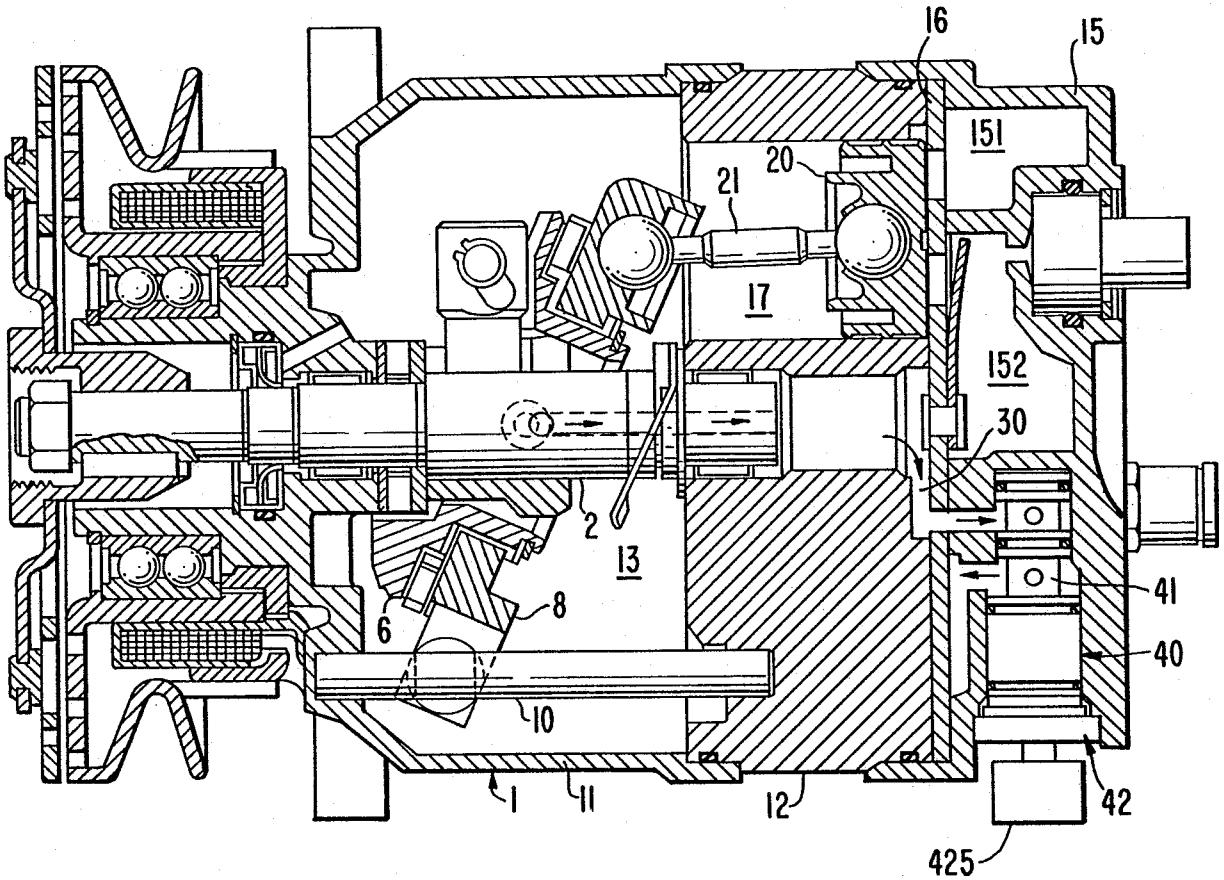
FIG. 12 is a cross sectional view of a wobble plate type compressor in accordance with another embodiment of this invention.

Variable displacement mechanism 40 includes first valve control device 41 disposed in cylinder head 15 and second valve control device 42 connected to first valve control device 41. Second valve control device 42 is located substantially outside of compressor 1. With reference to FIG. 13, first valve control device 41 includes cylindrical casing 411 which includes communication holes 411*a* and 411*b* to communicate with suction chamber 151 and crank chamber 13, respectively. Bellows 412 is disposed in the interior space of casing 411. Valve element 413 is attached to one end of bellows 412 and is slidably supported within a central hole of supporting plate 44 located near a reduced radius portion of casing 411. One end of valve element 413 extends past communication hole 411*a* and controls the opening and closing of hole 411*c* which is formed through a central portion of casing 411. Hole 411*c* is located between holes 411*a* and 411*b*. The opening and closing of 411*c* controls the communication between holes 411*a* and 411*b* and, thus, communication between suction chamber 151 and crank chamber 13.

Adjusting screw 415 is attached to the other end of bellows 412 and is screwed into a threaded hole formed through a central portion of plate 416 to adjust the operating point of bellows 412 and to hold bellows 412 in position. A plurality of holes 416*a* are formed through plate 416 to allow communication between an open end portion of casing 411 and the interior space of casing 411. Threaded portion 417 is formed on the inner surface of the open end portion of casing 411. First valve control device 41 is fastened to second valve control device 42 at this point.

Second valve control device 42 includes cover plate 421 which is fixed within cylinder head 15 and central boss 422 which extends away from cover plate 421 into cylinder head 15. The interior space of boss 422 is in communication with the interior space of first valve control device 41 as shown in FIG. 15.

Valve element 423 of second valve control device 42 extends into the interior space of boss 422. Cover plate 421 is formed with lateral passageway 424 to allow communication between the interior space of boss 422 and suction chamber 151. Valve element 423 is controlled by electromagnetic device 425 which is disposed on the outer side surface of cover plate 421. Threaded portion 426 is formed on an outer pheripheral portion of boss 422 and is screwed to threaded portion 417 of first valve control device 41 to fasten first valve control device 41 to second valve control device 42, as shown in FIG. 15.

In this embodiment, in operation of the air conditioner, the compressor is disposed in a cooling circuit. The pressure in accumulator A is detected by pressure switch 43 which controls electromagnetic device 425 as shown in FIG. 16. Condensor C, orifice tube O, and evaporator E are also included. Also, as shown in FIG. 17, pressure switch 43 normally acts to close the circuit, that is energize electromagnetic device 425. However, if the pressure in accumulator A is below a predetermined pressure, pressure switch 43 opens the circuit and electromagnetic device 425 is not energized.

If the pressure in accumulator A exceeds the predetermined pressure, electromagnetic device 425 causes valve element 423 to slide to the left in FIG. 15 to interrupt communication between suction chamber 151 and the interior space of valve mechanism 40. Bellows 412 is already contracted due to the initially high suction chamber pressure and maintains this position so that crank chamber 13 is in communication with suction chamber 151 through open hole 411c, and the compressor operates at maximum capacity.

If the pressure in accumulator A falls below the predetermined pressure, pressure switch 43 opens the circuit and electromagnetic device 425 is deenergized. Therefore, valve element 423 slides to the right and communication between suction chamber 151 and the interior space of first valve control device 41 is established. Bellows 412 expands due to the low suction chamber pressure, causing valve element 413 to slide to the right to close hole 411*c* and interrupt communication between suction chamber 151 and crank chamber 13. Since bellows 412 directly operates in accordance with a pressure change in suction chamber 151, the capacity of compressor 1 is changed by the pressure change in suction chamber 151.

This invention has been described in detail in connection with the preferred embodiments. The preferred embodiments are for example only and this invention is not restricted thereto. It will be easily understood by those skilled in the art that variations and modifications can be made easily within the scope of this invention, as defined by the claims.

I claim:

1. In a slant plate type refrigerant compressor for use in a refrigeration circuit, said compressor including a compressor housing having a central portion, a front end plate at one end and a rear end plate at its other end, said housing having a cylinder block provided with a plurality of cylinders and a crank chamber adjacent said cylinder block, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable in response to changes in the crank chamber pressure to vary the stroke length of said pistons and the capacity of the compressor, said rear end plate having a suction chamber and a discharge chamber, a passageway connected between said crank chamber and said suction chamber, and a variable displacement mechanism for controlling the closing and opening of said passageway to control communication between said suction and said crank chambers to vary the capacity of said compressor by adjusting the incline angle, said variable displacement mechanism including a valve control mechanism to directly open and close said passageway, the improvement comprising:

said valve control mechanism comprising a first valve control device, said first valve control device comprising a first valve element for controlling the opening and closing of said passageway, and an isolated pressure sensitive chamber within which said first valve element is partially disposed and which controls said first valve element; and a second valve control device to control the communication between said suction chamber and said isolated pressure sensitive chamber in accordance with changes in operating conditions of said compressor.

2. The refrigerant compressor of claim 1 wherein said first valve element opens and closes a hole to control communication between said crank chamber and said suction chamber.

3. The refrigerant compressor of claim 1 wherein said member comprises an inclined plate and said coupling means further comprises a wobble plate disposed adjacent said inclined plate.

4. The refrigerant compressor of claim 1 wherein said second valve control device comprises a casing with an interior space in communication with said isolated pressure sensitive chamber and with said suction chamber through a hole, a second valve element controlling the opening and closing of said hole, and a control element for said second valve element.

5. The refrigerant compressor of claim 4 wherein said first valve control device includes a bellows to control said first valve element.

6. The refrigerant compressor of claim 4 wherein said control element for said second valve element is an electromagnetic device.

7. The refrigerant compressor of claim 4 wherein said control element for said second valve element of said second valve control device is responsive to changes in pressure within said second valve control device.

8. The refrigerant compressor of claim 7 wherein said control element for said second valve element comprises a bellows connected to said second valve element at one end surface.

9. The refrigerant compressor of claim 4 wherein said control element for said second valve element is responsive to changes in temperature in the interior space of said second valve control device.

10. The refrigerant compressor of claim 9 wherein said control element of said second valve control device comprises a coil spring formed of a shaped memory alloy and a retainer plate attached to said second valve element.

11. The refrigerant compressor of claim 10 wherein said alloy comprises titanium-nickel.

12. The refrigerant compressor of claim 10 wherein said alloy comprises aluminum.

* * * * *